US007036444B2

(12) United States Patent
Flückiger

(10) Patent No.: US 7,036,444 B2
(45) Date of Patent: May 2, 2006

(54) LOCKING DEVICE FOR A BOBBIN

(75) Inventor: Hans Flückiger, Oetwil am See (CH)

(73) Assignee: Fritz Gegauf Aktiengesellschaft BERNINA-Nahmaschinenfabrik, Steckborn (CH)

( * ) Notice: Subject to any disclaimer, the term of this patent is extended or adjusted under 35 U.S.C. 154(b) by 0 days.

(21) Appl. No.: 10/968,738

(22) Filed: Oct. 19, 2004

(65) Prior Publication Data

US 2005/0126461 A1 Jun. 16, 2005

(30) Foreign Application Priority Data

Dec. 10, 2003 (CH) ..... 2105/03

(51) Int. Cl.
*D05B 57/26* (2006.01)

(52) U.S. Cl. ..... 112/231

(58) Field of Classification Search ..... 112/188, 112/180, 279, 231; 242/170, 570, 590, 613, 242/118, 130, 134, 137
See application file for complete search history.

(56) References Cited

U.S. PATENT DOCUMENTS

| | | | | | |
|---|---|---|---|---|---|
| 663,675 | A | * | 12/1900 | Diehl et al. | 112/180 |
| 832,414 | A | * | 10/1906 | Porter | 112/180 |
| 2,813,500 | A | * | 11/1957 | Goosman et al. | 112/231 |
| 2,848,965 | A | * | 8/1958 | Ayres | 112/231 |
| 3,381,643 | A | * | 5/1968 | Meloy, Jr. | 112/231 |

FOREIGN PATENT DOCUMENTS

| | | |
|---|---|---|
| DE | 38 19 405 | 12/1988 |
| DE | 195 10 830 | 9/1996 |
| GB | 2 149 433 | 6/1985 |

* cited by examiner

*Primary Examiner*—Ismael Izaguirre
(74) *Attorney, Agent, or Firm*—Volpe and Koenig, P.C.

(57) ABSTRACT

A locking device for bobbins (3) in the hook base (1) of a sewing machine is provided by a locking element (21) that can move in the axial direction. The locking element (21) is spring-loaded and lies in an ejection and loading position inclined to the rotational axis (X) of the hook base (1), so that the bobbin (3) can be placed or removed. As soon as the bobbin (3) is inserted into the hook base (1), the locking element (21) tips and locks on the bobbin rod (9).

11 Claims, 8 Drawing Sheets

LOCKING DEVICE FOR A BOBBIN

BACKGROUND

The invention is directed to a locking device for a bobbin that is located in a holding space in the hook base for the bobbin for retaining the bobbin in the hook base.

The bobbin of sewing machines, especially household sewing machines, either can be stored directly in the hook base and is thus directly accessible or it can be inserted into a bobbin case, which is designed specifically for this purpose and which is stored on its side in the hook base. The present invention relates to a bobbin stored directly in the hook base. However, it can also be used for a bobbin stored indirectly in a bobbin case.

From DE-A1 3819405, a bobbin case for rotary hooks is known, in which the bobbin is pushed onto a cylindrical bobbin rod, which is part of the bobbin case, and is held by a securing lever. The securing lever, provided as a two-arm lever, is held by a spring-loaded plate in two positions (open position and working position). The lock is released by manually pivoting the lever by 90° into an axis-parallel position. Then the bobbin can be lifted out of the hook base. To simplify the lifting of the bobbin from the hook base, it is proposed in DE-A1 1951038 to insert a helical spring between the bobbin bottom side, i.e., the underlying bobbin flange, and the hook base. After the lever releases the bobbin, this spring pushes the bobbin partially out of the hook base. At the same time, during sewing, the spring exerts a braking moment on the bobbin and this moment has an effect that is dependent on the top surface of the bobbin and cannot be influenced. This can impair the sewing process.

From GB-A 2149433, a bobbin holder is further known, in which the bobbin is held by a spring-loaded holding rod that can be moved through the bobbin. The holding rod can be brought from the holding position into the removal position by a quarter turn and can be removed together with the bobbin completely from the hook base. Consequently, when a full bobbin is inserted, the holding rod must be inserted into the bobbin and then secured.

SUMMARY

An objective of the present invention is to create a locking device for a bobbin, which can hold the bobbin in the hook base without exerting uncontrollable braking forces on the bobbin and which also pushes the bobbin or the bobbin case from the hook base in the axial direction after unlocking.

This problem is solved by a locking device according to the features of the invention by providing the locking element that can move in the hook base and is held in the locking position and in the unlocking position by the force of a spring. Advantageous configurations of the invention are described in more detail below.

Through light pressure on the locking element, which extends over the bobbin in the axial direction, the holding position, in which the bobbin is kept in the hook base, can be released and simultaneously the bobbin can be partially ejected. A new bobbin to be inserted into the hook base is locked by pushing the bobbin into the hook base in the axial direction until it moves into the recess in the hook base. Then no other locking manipulations are necessary. The bobbin held by the locking element is in no way braked by the locking element, because the latter does not contact the bobbin in a force-fit connection. The locking element formed only of two parts is connected to the hook base so that it cannot be lost and also remains on the hook base after removal of the bobbin.

BRIEF DESCRIPTION OF THE DRAWINGS

The invention is described in more detail with reference to an illustrated embodiment. In the drawings.

DETAILED DESCRIPTION OF THE PREFERRED EMBODIMENTS

Figure 1:
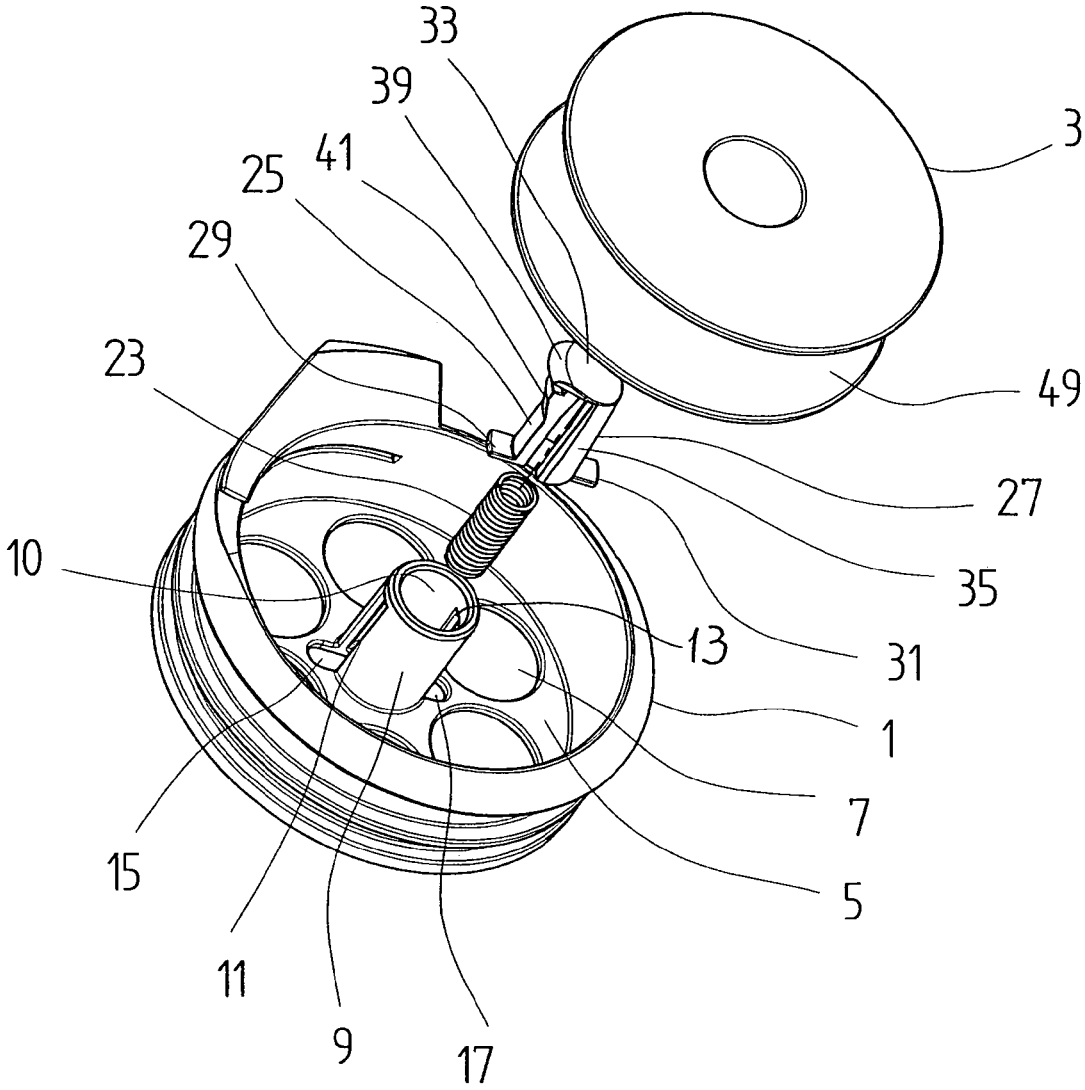
FIG. 1 is a perspective exploded view of a hook base with the locking element and a bobbin.
Figure 2:
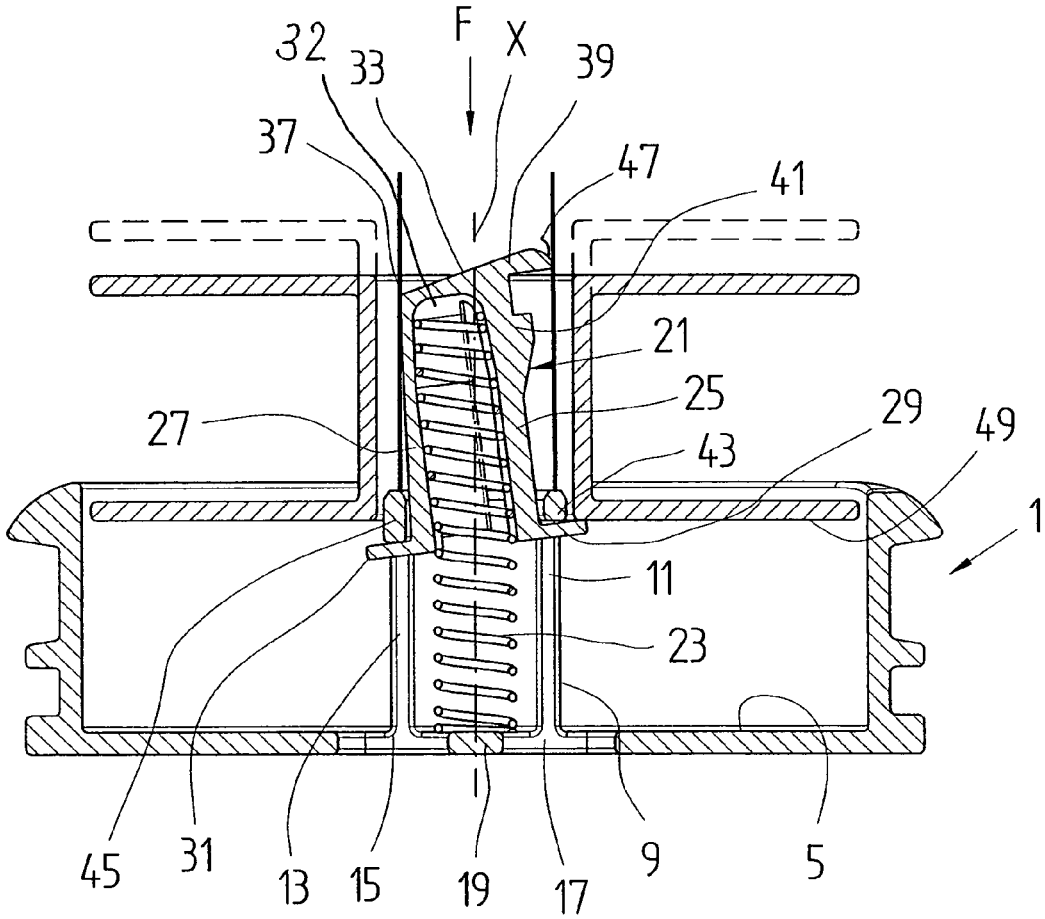
FIG. 2 is an axial section view through the hook base with ejected bobbin.
Figure 6:
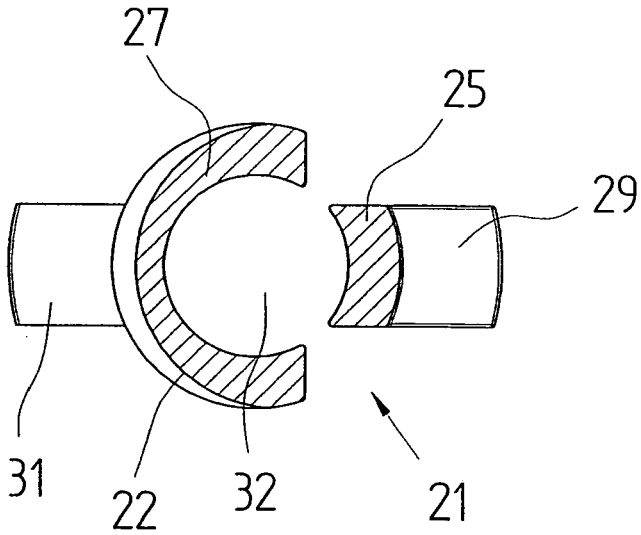
FIG. 6 is a cross sectional view through the locking element along line V—V in FIG. 5.

In FIG. 1, a hook base for a bobbin 3 is designated with reference number 1. The bobbin 3 can have flanges with or without weight-reducing holes. The hook base 1 comprises a base 5, which can be penetrated by holes 7 for reducing the mass. In the center of the base 5, a hollow cylindrical bobbin rod 9 with a central hole 10 is formed. Two opposing slots 11 and 13, which extend in the axial direction, are formed in the outer surface of the rod. In the region of the slots 11, 13, the base 5 can be partially perforated, so that recesses 15, 17 are produced. The two recesses 15, 17 are not connected to each other, but instead they are separated by a connecting piece 19 (FIG. 2). The connecting piece 19 is part of the base 5. The axial extent of the first slot 11 is greater than the axial extent of the second slot 13, so that the upper ends 43, 45 of the slots 11 and 13 are not the same distance from the base 5 (cf. especially FIG. 2). The two slots 11, 13 form a rotational safety device and an axial stop for a locking element 21, which is pretensioned by a helical spring, in short form, the spring 23. The locking element 21 comprises two legs 25, 27, on each of which an outwardly projecting foot 29, 31, respectively, is formed. The two legs 25, 27 lie at a distance from each other in the essentially cylindrical outer surface 22 of the locking element 21 and are provided with a holding plate 33 on the ends opposite the feet 29, 31. Preferably, the two legs 25, 27 are formed by a slotted cylinder (cf. FIG. 6). A pocket hole 32 in the locking element 21 forms a guide for the spring 23. A holding plate 33 projects over the first leg 25 in the radial direction. The outer-lying surface 35 of the second leg 27 lies flush with the rear edge 37 of the holding plate 33. Underneath the tab 39 projecting over the first leg 25 there is a step-shaped shoulder 41 leading to the holding plate 33 spaced at a distance to the lower edge of the tab. On the side of the foot, the shoulder 41 is wedge-shaped and transitions continuously into the surface of the foot 25. The two feet 29, 31 project past the outer surface of the bobbin rod 9, when the locking element 21 is inserted into the hole 10 in the hook base 1 or into the bobbin rod 9 in the hook base 1. They are guided laterally into the two slots 11, 13 (cf. FIG. 2). The spring 23 is supported at the bottom on the connecting piece 19 and at the top on the bottom side of the holding plate 33.

Figure 3:
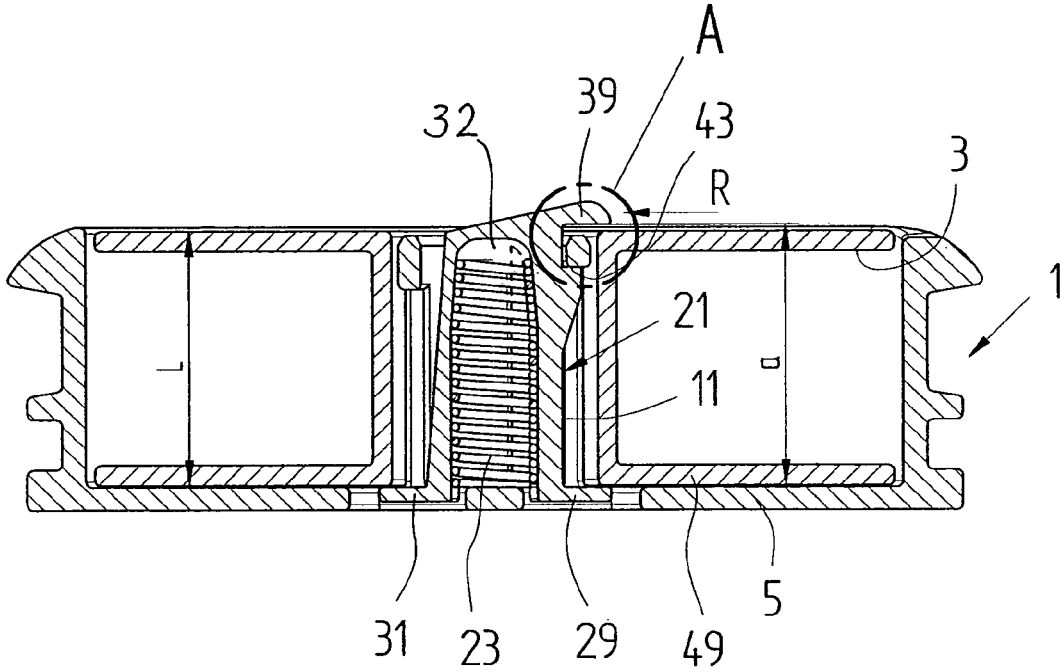
FIG. 3 is an axial section view through the hook base with locked bobbin.
Figure 4:
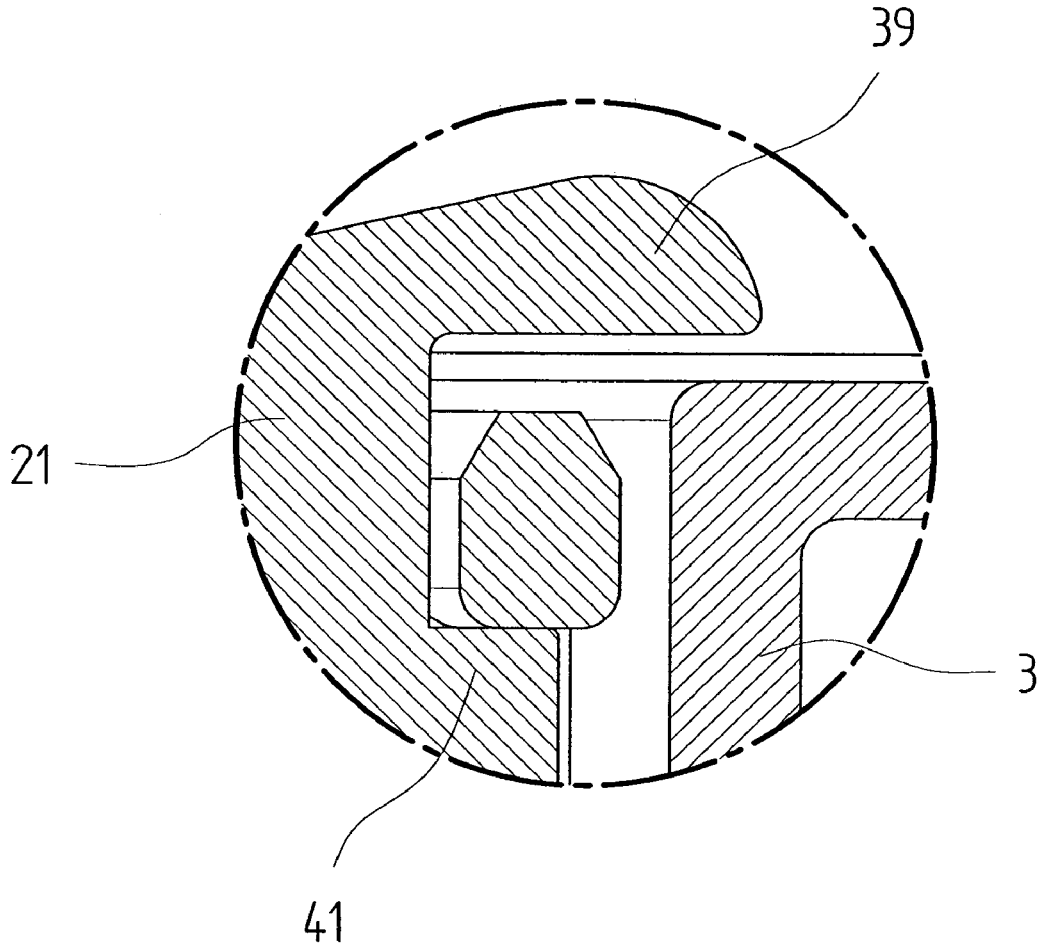
FIG. 4 is an enlarged view of the area indicated at A in FIG. 3.

The locking element 21 can assume two different extreme positions in the bobbin rod 9: the bobbin removal position according to FIG. 2 and the working position according to FIGS. 3 and 4.

In the removal position for the bobbin 3 according to FIG. 2, the locking element 21 lies in its maximum extended position due to the force of the spring 23. The two feet 29, 31 contact the two upper ends 43 and 45 of the slots 11 and 13 and prevent the locking element 21 from releasing from the bobbin rod 9. Because the first slot 11 has a greater axial extent upwards, but the two feet 29, 31 are arranged symmetrically on the locking element 21, the locking element 21 is forced into a diagonal position (cf. FIG. 2). Through the diagonal position of the locking element 21 in terms of the hook base axis X, the holding plate 33 also shifts in the direction towards the X axis, so that its rear edge 37 and the front edge 47 of the tab 39 are at the same distance to the X axis. This backward pivoting of the tab 39 in the direction towards the rotational axis X has the effect that the bobbin 3 is now guided in the axial direction unimpaired by the locking element 21 and can be removed or placed. When the new bobbin 3 is inserted, this is pushed on in the axial direction until the lower flange 49 of the bobbin 3 first contacts the higher foot 29 of the locking element 21. Through further pressure with a force F on the bobbin 3 or on the holding plate 33, the locking element 21 is pressed against the force of the spring 23 successively downwards. Finally, when the flange 49 contacts the base 5 of the hook base 1, the locking element 21 tips in the clockwise direction and the shoulder 41 under the tab 39 locks on the top end 43 of the slot 11 in the bobbin rod 9 (FIGS. 3 and 4). The two feet 29, 31 now lie parallel to the base 5 and to the lower flange 49 of the bobbin 3. Because the distance a between the bottom side of the tab 39 and the top side of the base 5 is greater than the total axial length L of the bobbin 3 (cf. FIG. 3), this is kept in the hook base 1 with play. Due to the force of the spring 23, the locking of the locking element 21 is preserved until a radial shifting force R is exerted on the tab 39 of the locking element 21 by the operator of the sewing machine in order to remove the bobbin 3. Due to the force R, the locking element 21 in FIG. 3 pivots in the counterclockwise direction, the shoulder 41 releases from the slot 11, and the bobbin 3 is pushed out at least partially by the force of the spring 23 together with the locking element 21 from the interior of the hook base 1 and can be removed.

Figure 5:
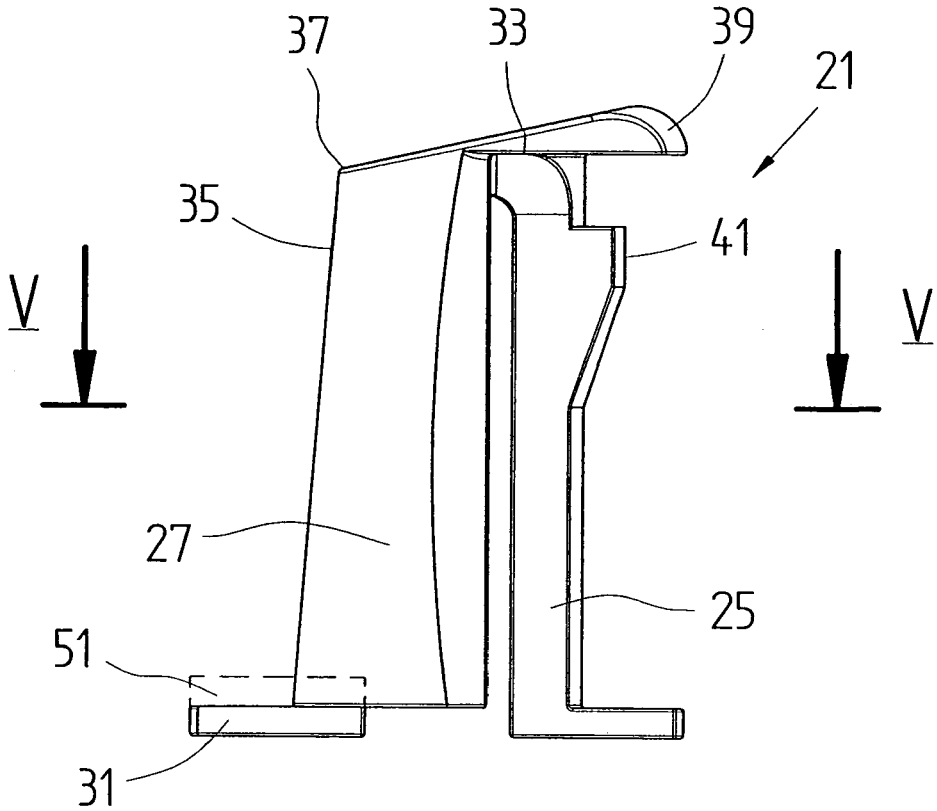
FIG. 5 is a side view of the locking element.
Figure 10:
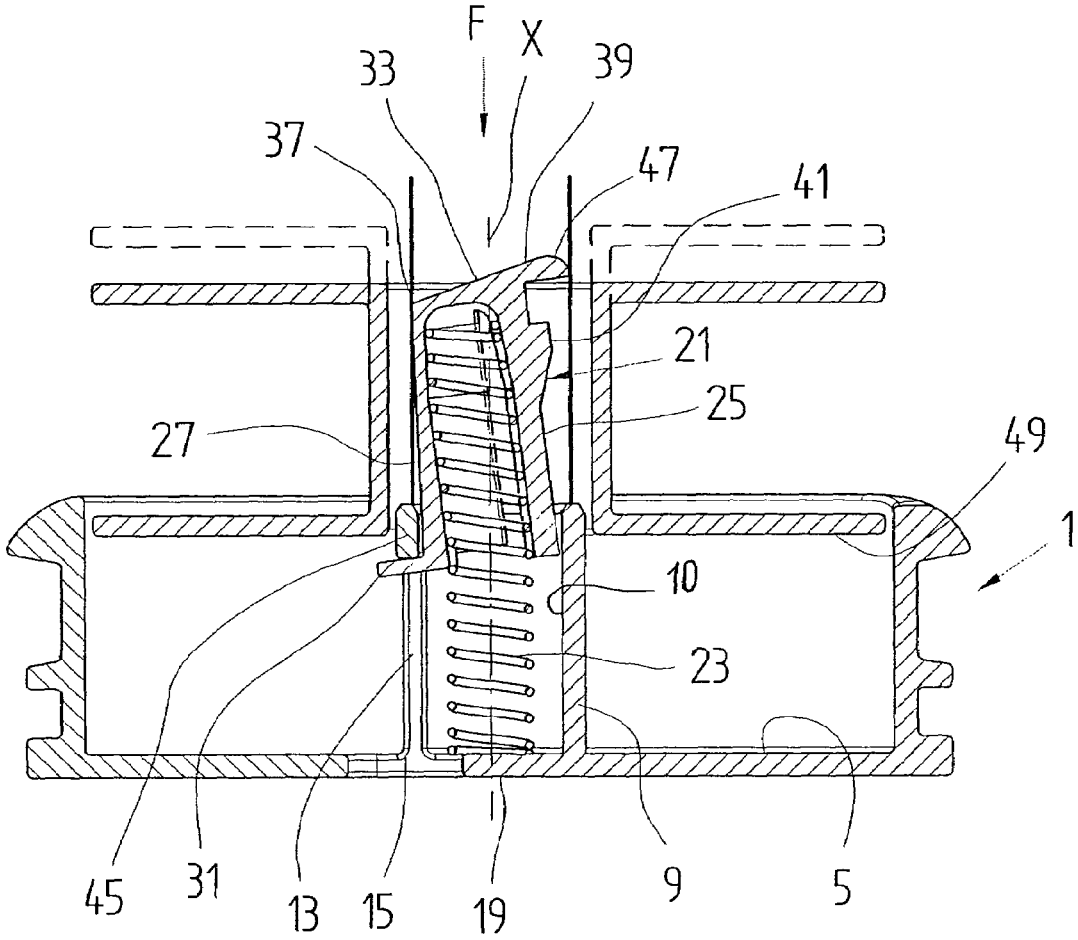
FIG. 10 is an axial section view through the hook base with ejected bobbin in another configuration of the invention.

In another configuration of the invention according to FIG. 10, only one slot 13 can be formed in the bobbin rod 9, in which a single foot 31 engages the locking element 21. Thanks to play in the hole 10, the locking element 21 positions itself diagonally in the unlocked position and therefore releases the bobbin 3. The diagonal position of the locking element 21 in the extended position according to FIG. 2 could also be reached alternatively if the foot 31, which lies opposite the tab 39, has a greater axial thickness, with the two slots 11, 13 having the same axial length (cf. dashed line 51 in FIG. 5). However, this configuration has the disadvantage that the overall height of the hook base 1 is increased correspondingly, the height of the bobbin 3 is reduced or the bobbin must be back cut in the central region, so that the additional axial height of the foot 31 can find space in the recess 15.

Figure 7:
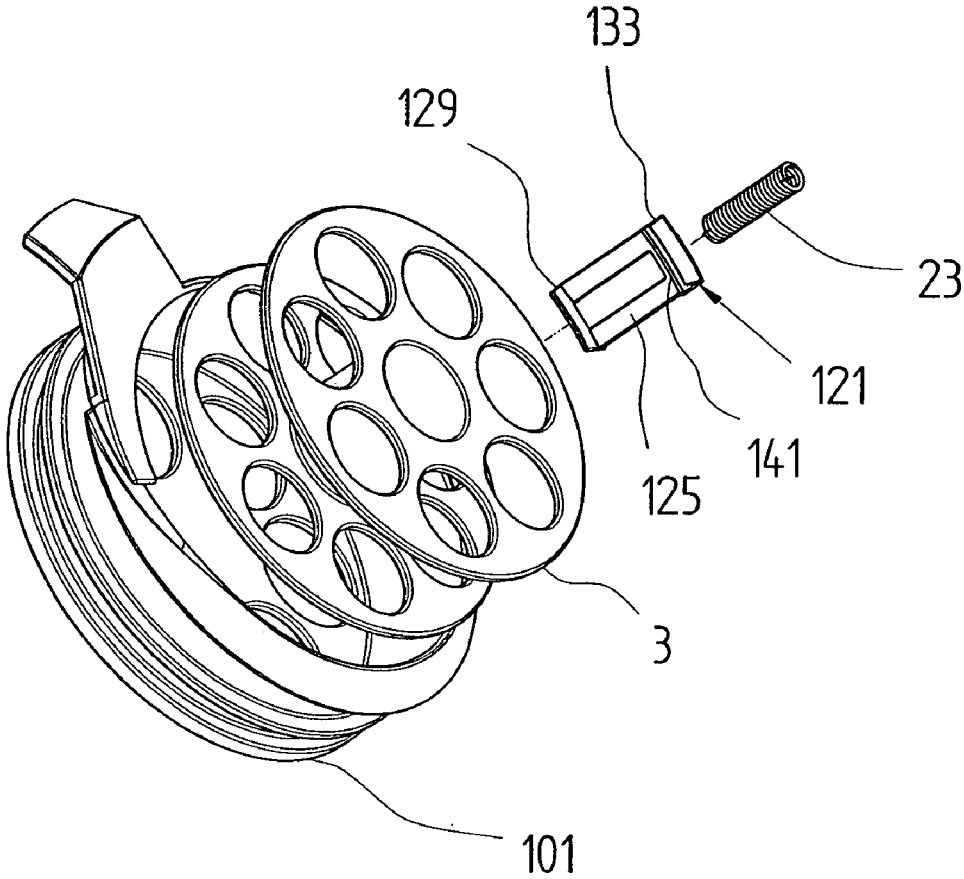
FIG. 7 is an exploded perspective view of a hook base with a locking element and a bobbin in another configuration of the invention.
Figure 8:
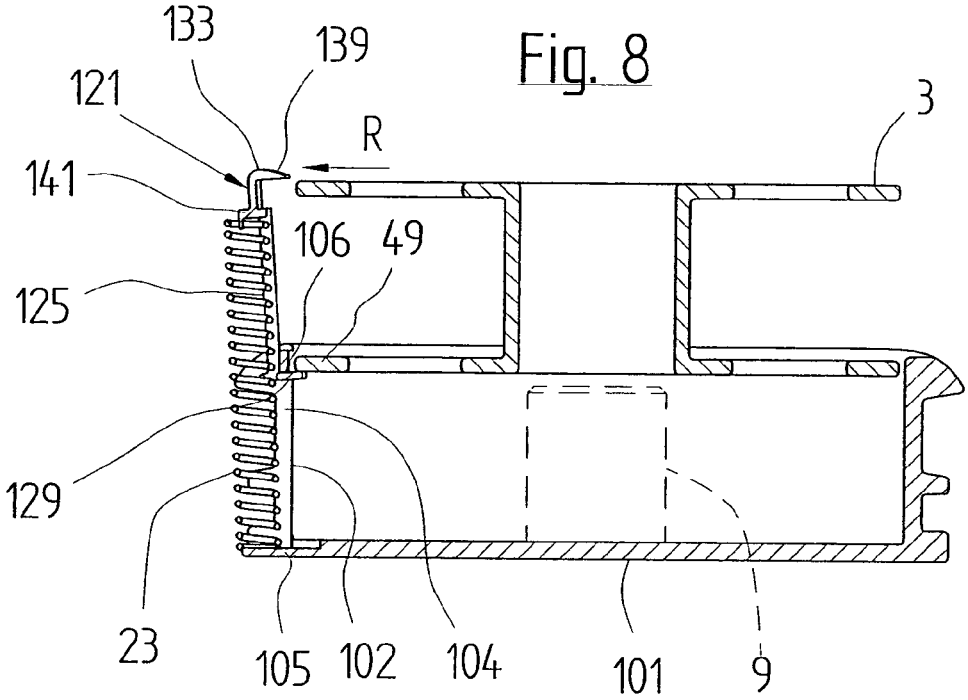
FIG. 8 is an axial section view through the hook base with ejected bobbin according to FIG. 7.
Figure 9:
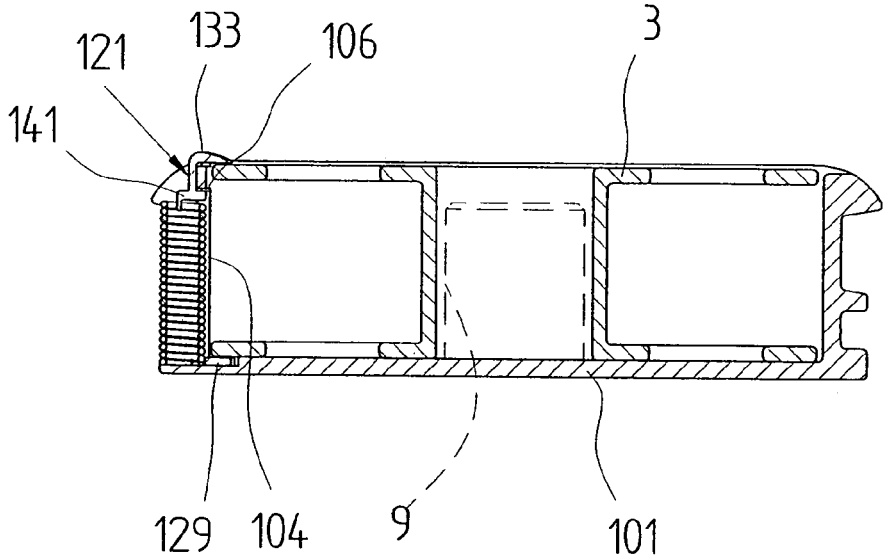
FIG. 9 is an axial section view through the hook base with locked bobbin.

In another configuration of the invention according to FIGS. 7–9, the locking element 121 is arranged on the periphery of the hook base 101. The hook base 101 can also be manufactured without a central bobbin rod and the locking element 121 is guided in an axial slot 104 formed in the outer surface 102 of the hook base 101 (FIGS. 8 and 9). The locking element 121 comprises a holding plate 133, a foot 129, and two legs 125 connecting the holding plate 133 and the foot 129. The foot 129 and a tab 139, which is part of the holding plate 133, project past the surface of the leg 125 and function as stops for the lower flange 49 of the bobbin 3 or the upper flange of the bobbin 3. The spring 23 is supported with its lower end on the base 105 of the hook base 101. The upper end of the spring 23 contacts a shoulder 141 arranged at a distance from the bottom side of the holding plate 133 or the tab 139.

When the bobbin 3 has been inserted completely into the hook base 101, the flanges of the bobbin 3 lie between the foot 129 and the tab 139 with play. The shoulder 141 is pressed onto the upper end 106 of the axial slot 104 by the spring 23.

For unlocking the bobbin 3 and removing the latter from the hook base 101, a force in the direction of the arrow R is exerted on the holding plate 133 until the shoulder 141 is led out of engagement with the upper end 106 of the slot 104 and therefore the locking element 121 is guided upwards by the force of the spring 23 so far until the foot 129 contacts the upper end 106 of the slot 104 (FIG. 8). Due to the shifting force R, the locking element 121 is pivoted and the bobbin 3 can be removed unimpaired from the hook base 101.

When the bobbin 103 is inserted according to FIG. 9, the bobbin 3 is held by the locking element with play, i.e., an uncontrollable, braking force is not applied to the bobbin during sewing.

Obviously, in all of the described configurations, the holding plates 33, 133 are embodied such that the bobbin thread cannot remain hanging when it is drawn out and also the drawing properties are not negatively affected.

Furthermore, the holding plate 33, 133 can be formed with a taper in the direction towards the tab 39, 139 such that, when the locking element has been brought into the pushed-in position without a bobbin 3 due to an error, when a bobbin 3 is pushed over the element, the locking element 21, 121 is immediately unlocked, the bobbin is pushed onto the hollow bobbin rod, and the locking element assumes the bobbin locking position again through further pushing of the bobbin 3.

LEGEND

1/101 Hook base
102 Outer surface of 101
3 Bobbin
104 Axial slot in 101
5/105 Base
106 Upper end of 104
7 Holes
9 Bobbin rod
10 Hole in 9
11 First slot
13 Second slot
15 First recess
17 Second recess
19 Connecting piece

21/121 Locking element
22 Outer surface of 21
23 Spring
25/125 First leg
27 Second leg
29/129 First foot
31 Second foot
32 Pocket hole in 21
33/133 Holding plate
35 Outer-lying surface of 27
37 Rear edge of 33
39/139 Tab
41/141 Shoulder
43 Upper end of 11
45 Upper end of 13
47 Front edge
49 Lower flange

The invention claimed is:

1. A locking device for a bobbin (3) in a hook base (1, 101) of a sewing machine, the locking device comprising a holding space in the hook base (1, 101) for the bobbin (3) and a locking element (21) for fixing the bobbin (3) in the hook base (1), the locking element (21) can move in an axial direction in the hook base (1, 101) and is held in a locking position and in an unlocking position by the force of a spring (23), wherein in the locking element (21), an axial pocket hole (32) is formed, in which the spring (23) is inserted and supported at its ends.

2. Locking device according to claim 1, wherein the locking element (21) is held on a bobbin rod (9) in the hook base (1) and secured against rotation.

3. Locking device according to claim 2, wherein the bobbin rod (9) includes a central hole (10), in which the locking element (21) is guided.

4. Locking device according to claim 1, wherein the locking element (121) is guided in an axial slot (104) in an outer surface of the hook base (101) so that it can move in the axial direction and can be locked.

5. Locking device according to claim 4, wherein the locking element (121) comprises a foot (129), a holding plate (133), and a shoulder (141) located at a distance to the holding plate, and at least one leg (125) connecting the foot (129) and the holding plate (133), as well as a spring (23), wherein the shoulder (141) and the foot (129) determine the two extreme positions of the locking element (121) in the hook base (101).

6. Locking device according to claim 1, wherein the spring (23) is supported at a second end thereof on a base (5) or a connecting piece (19) of the hook base (1).

7. Locking device according to claim 6, wherein at least one axial slot (11, 13) is formed on a bobbin rod (9), and a foot (29, 31) formed on the locking element (21) engages the slot.

8. Locking device according to claim 6, wherein a recess (15, 17) is formed in the base (5) of the hook base (1) underneath one or more feet (29, 31), the one or more feet (29, 31) engage in the recess when the bobbin (3) is inserted into the hook base (1).

9. Locking device for a bobbin (3) in a hook base (1, 101) of a sewing machine, the locking device comprising:

a holding space in the hook base (1, 101) for the bobbin (3);

a spring (23) supported at an end thereof on a base (5) or a connecting piece (19) of the hook base (1);

a locking element (21) for fixing the bobbin (3) in the hook base (1), the locking element comprising an axial pocket hole in which the spring (23) is inserted and supported and comprising a foot (29, 31), the locking element (21) being movable in the hook base (1, 101) and being held in a locking position and in an unlocking position by force of the spring (23); and a bobbin rod (9) comprising first and second slots (11, 13), the first slot (11) being longer than the second slot (13), the foot (29, 31) formed on the locking element (21) being engaged in the first and second slots (11, 13).

10. Locking device for a bobbin (3) in a hook base (1, 101) of a sewing machine, the locking device comprising:

a holding space in the hook base (1, 101) for the bobbin (3);

a spring (23) supported at an end thereof on a base (5) or a connecting piece (19) of the hook base (1);

a locking element (21) for fixing the bobbin (3) in the hook base (1), the locking element comprising an axial pocket hole in which the spring (23) is inserted and supported, comprising a foot (29, 31), and comprising a holding plate (33) with a tab (39) projecting over an outer surface (22) of the locking element (21) retained by at least one of the feet (29) of the locking element (21); the locking element (21) being movable in the hook base (1, 101) and being held in a locking position and in an unlocking position by force of the spring (23); and a bobbin rod (9) comprising at least one axial slot (11, 13), the foot (29, 31) formed on the locking element (21) being engaged in the at least one axial slot.

11. Locking device according to claim 10, wherein a shoulder (41) is formed offset to a surface of the holding plate (33) in the axial direction, with the shoulder engaging the slot (11) when the locking element (21) is inserted into the bobbin rod (9).

* * * * *